United States Patent [19]

Fox

[11] 4,077,669

[45] Mar. 7, 1978

[54] SELF-CENTERING POSTURE SEAT

[76] Inventor: Louis Fox, 100 Mt. Arlington Blvd., Landing, N.J. 07850

[21] Appl. No.: 760,647

[22] Filed: Jan. 19, 1977

[51] Int. Cl.[2] ..... A47C 7/02

[52] U.S. Cl. ..... 297/452

[58] Field of Search ..... 297/17, 252, 284, 454, 297/455, 456, 452, 390; 5/345 R, 338

[56] References Cited

U.S. PATENT DOCUMENTS

| | | | |
|---|---|---|---|
| 2,147,958 | 2/1939 | Angers | 297/454 X |
| 2,876,829 | 3/1959 | Johnson | 297/390 |
| 2,970,638 | 2/1961 | Halter | 297/456 |
| 3,107,944 | 10/1963 | Baermann | 297/455 |
| 3,323,151 | 6/1967 | Lerman | 297/454 |
| 3,511,537 | 5/1970 | Ackerman | 297/454 |
| 3,606,463 | 9/1971 | Brooks | 297/455 |
| 3,679,261 | 7/1972 | Slabakov | 297/453 |

*Primary Examiner*—James T. McCall
*Attorney, Agent, or Firm*—Pennie & Edmonds

[57] ABSTRACT

A self-centering posture seating device is adapted to induce proper posture in seated persons. Specifically, a back support member designed to provide resilient support selectively in the region of the lumbar vertebra of a seated person is conjoined with a posture seating device designed to provide resilient support primarily in the spaced-apart regions corresponding to the ischial tuberosities. The result is a "self-centering" posture seating device which is noticeably more comfortable when properly used than it is when improperly used.

9 Claims, 2 Drawing Figures

SELF-CENTERING POSTURE SEAT

BACKGROUND OF THE INVENTION

This invention relates to seating equipment; and, more particularly, to a self-centering posture seating device adapted to induce proper posture in seated individuals.

The present invention is an improvement on posture seating devices of the type disclosed in U.S. Pat. No. 2,557,269 issued to the present inventor on June 19, 1951. The U.S. Pat. No. 2,557,269 devices comprise, in substance, planar seating devices designed to provide resilient support selectively in spaced-apart regions corresponding to the main areas of pelvic support of a seated person known as the ischial tuberosities. When a person sits properly centered on the device, the weight of his body above the pelvis is transmitted to the resilient support regions by way of the ischial tuberosities, and the spinal column is induced to assume the proper position for correct posture. As a result, the various organs within the body are maintained in proper position, and fatigue and pain are minimized.

In use of this posture seating device, however, it has been observed that some persons are so inured to improper posture that they do not sit properly centered, and much of the potential benefit of the device is consequently lost to these individuals.

SUMMARY OF THE INVENTION

In accordance with the present invention, a self-centering posture seating device is adapted to induce proper posture in seated persons. Specifically, a back support region designed to provide resilient support selectively in the region of the lumbar vertebra of a seated person is conjoined with a posture seating device designed to provide resilient support in the spaced-apart regions corresponding to the ischial tuberosities. The result is a "self-centering" posture seating device which is noticeably more comfortable when properly used than it is when improperly used. This invention is not only beneficial to persons with back trouble but also to persons without back trouble.

BRIEF DESCRIPTION OF THE DRAWINGS

The advantages, nature and various additional features of the present invention will appear more fully upon consideration of the illustrative embodiments now to be described in detail in connection with the accompanying drawings in which.

For convenience of reference, the same elements are given the same reference numerals throughout the drawings.

DETAILED DESCRIPTION

Figure 1:
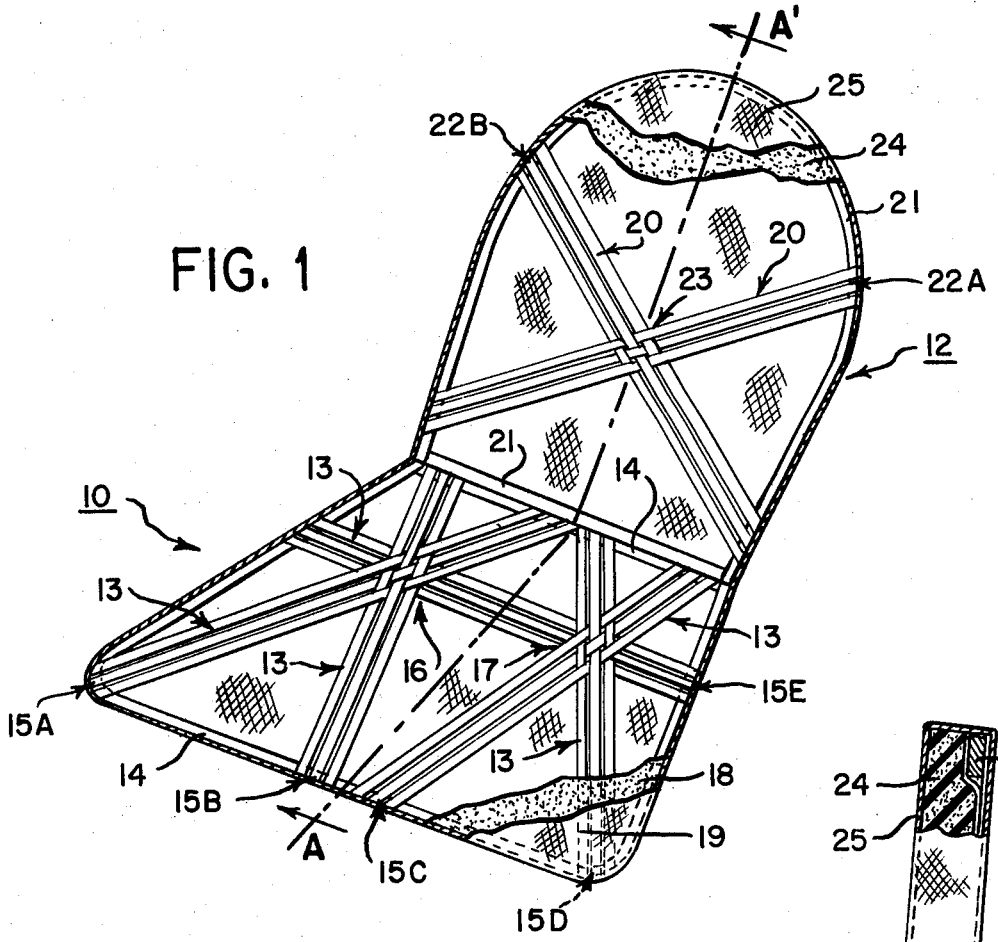
FIG. 1 is a perspective view with parts broken away of a self-centering posture seating device in accordance with the invention.
Figure 2:
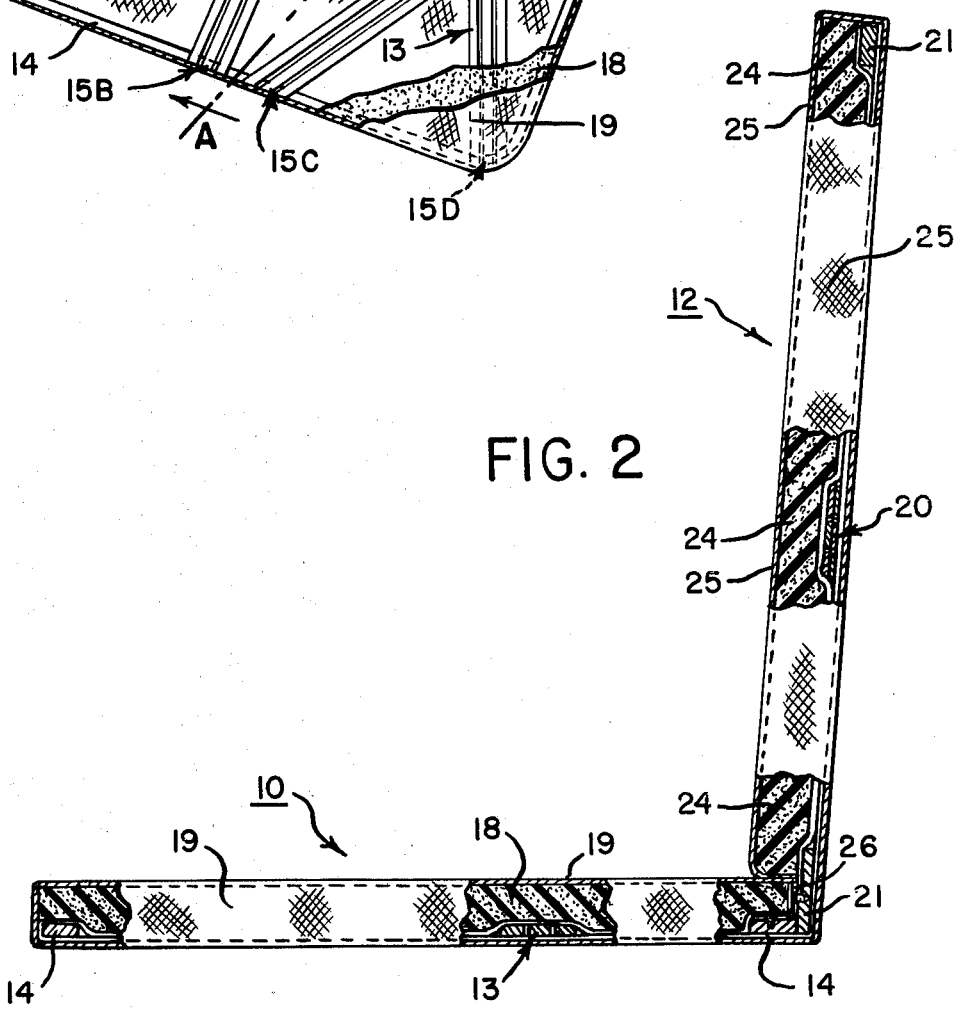
FIG. 2 is a cross section of the device shown in FIG. 1 along the line A–A'.

Referring to the drawings, FIGS. 1 and 2 illustrate broken-away views of a self-centering posture seating device comprising a seat support member generally denoted 10 and a back support member generally denoted 12. In essence, the seat support member 10 is a seating device designed to provide resilient support primarily in the spaced-apart regions corresponding to the ischial tuberosities of a seated person. More specifically, support is preferably provided by a plurality of resilient bands 13 stretched across a rigid seat frame 14 preferably of aluminum tubing, in a plurality of sets 15A, 15B, 15C, 15D, and 15E intersecting in two regions 16 and 16 spaced apart by the distance separating the ischial tuberosities of a seated person. Depending upon the size of the support regions, this distance can vary from four to six inches. For comfort, an overall layer 18 of soft foam is preferably applied over both the metal frame and the resilient bands 13, and an outer protective cover 19 of fabric or like material can be applied around the seat support member. The resilient bands can be bands of thick rubber or like material such as bands of 1/16th inch thick rubber. If desired, optional nonresilient reinforcement can be provided in the form of loose, nonresilient bands (not shown) which effectively limit the amount of total penetration into the seat upon perturbations such as would be caused by a person dropping onto the seat or by a vehicle hitting bumps.

Back support member 12 is a somewhat similar structure designed to provide resilient support primarily in the region of the lumbar vertebra. Such support is preferably provided by a plurality of resilient bands 20 stretched across a rigid back support frame 21 in a plurality of sets 22A and 22B intersecting in region 23. The back support member 12 is either rigidly or hingeably conjoined to seat support member 10 in such a manner that support region 23 is centered with respect to support regions 16 and 17, and disposed thereabove by the approximate height of the lumbar vertebra of a seated person. Again, depending on tne size of the support region, this distance can vary from 4 to 6 inches. As in the case of the seat support, an overall layer of soft foam 24 and an outer cover 25 can be applied around the back support member for comfort and protection. Preferably, the members 10 and 12 are conjoined by coupling together metal frames 14 and 21, as by hinging by hinge 26.

The advantage of this posture seating device relative to those of comparable simplicity heretofore known is that it is substantially "self-centering" and provides enhanced posture controlling support. The region of the lumbar vertebra located between concave and convex curves in the spinal column is a critical support region for the back, and a seated person instinctively moves this region into a support region. Such instinctive motion automatically assures that the seated person will be properly centered with respect to the regions for supporting the ischial tuberosities, thereby securing the full benefits of the posture seating device.

While the invention has been described in connection with a small number of specific embodiments, it is to be understood that these embodiments are merely illustrative of many other specific embodiments which also utilize the principles of the invention. Thus, numerous and varied devices can be devised by those skilled in the art without departing from the spirit and scope of the present invention.

I claim:

1. A self-centering posture seating device adapted to induce proper posture in a seated person comprising:

a seat support member for providing regions of resilient seat support to a seated person primarily in the spaced apart regions corresponding to the ischial tuberosities comprising a rigid seat frame and a plurality of stretched resilient bands intersecting within said frame in two regions spaced apart by the distance separating the ischial tuberosities of a seated person; and conjoined to said seat support member, a back support member for providing a region of resilient back support to a seated person primarily in the region corresponding to the lumbar vertebra comprising a rigid back frame and a plurality of stretched resilient bands intersecting within said frame at the approximate height of the lumbar vertebra of a seated person, said region of resilient back support being centered with respect to said regions of resilient seat support.

2. A seating device according to claim 1 wherein said back support member is rigidly conjoined to said seat support member.

3. A seating device according to claim 1 wherein said back support member is hingeably conjoined to said seat support member.

4. A seating device according to claim 1 including a layer of soft foam material applied over said rigid seat frame and said resilient bands, thereby enhancing the comfort of the seat support.

5. A seating device according to claim 1 including a layer of soft foam applied over said rigid back support member and said resilient bands, thereby enhancing the comfort of the back support.

6. A seating device according to claim 4 including a protective outer cover of material applied around said seat support member.

7. A seating device according to claim 5 including a protective outer cover of material applied around said back support member.

8. A seating device according to claim 1 wherein said rigid seat frame comprises aluminum tubing.

9. A seating device according to claim 1 wherein said rigid back frame comprises aluminum tubing.

* * * * *